US011391063B2

(12) United States Patent
Lai

(10) Patent No.: US 11,391,063 B2
(45) Date of Patent: Jul. 19, 2022

(54) CABLE LOCK HAVING DUAL UNLOCKING MECHANISM

(71) Applicant: THE SUN LOCK INTERNATIONAL COMPANY LIMITED, Tuen Mun (HK)

(72) Inventor: Karl Lai, Tai Po (HK)

(73) Assignee: THE SUN LOCK INTERNATIONAL COMPANY LIMITED, Tuen Mun (HK)

( * ) Notice: Subject to any disclaimer, the term of this patent is extended or adjusted under 35 U.S.C. 154(b) by 625 days.

(21) Appl. No.: 16/423,508

(22) Filed: May 28, 2019

(65) Prior Publication Data

US 2020/0011085 A1 Jan. 9, 2020

Related U.S. Application Data

(60) Provisional application No. 62/694,244, filed on Jul. 5, 2018.

(51) Int. Cl.
*E05B 37/00* (2006.01)
*E05B 37/02* (2006.01)
(Continued)

(52) U.S. Cl.
CPC ..... *E05B 37/0034* (2013.01); *E05B 37/025* (2013.01); *E05B 67/003* (2013.01)

(58) Field of Classification Search
CPC .. E05B 37/0034; E05B 37/025; E05B 67/003; E05B 15/00; E05B 67/00;
(Continued)

(56) References Cited

U.S. PATENT DOCUMENTS 972,171 A 10/1910 Dupont
5,156,028 A * 10/1992 Jiang ..... E05B 67/006 70/30
(Continued)

FOREIGN PATENT DOCUMENTS

CN 101555740 A 10/2009
CN 202970159 U 6/2013
(Continued)

OTHER PUBLICATIONS

Combined Search and Examination Report dated Dec. 10, 2019 in Application No. GB1909533.0 (5 pages).
(Continued)

*Primary Examiner* — Lloyd A Gall
(74) *Attorney, Agent, or Firm* — Ware, Fressola, Maguire & Barber LLP

(57) ABSTRACT

A lock has a flexible cable, instead of a shackle. The lock has a shaft moveable relative to the lock body so the top part of the shaft is moved out of the lock body to open the lock. The lock has a combination unlocking system and a key-overriding system. The lock can be unlocked by a lock-opening combination or by a correct key. The first end of the cable is fixedly attached to the lock body and the second end is removably engaged with a shaft slot. When the lock is in the locked mode, the shaft slot is located inside the lock body, preventing the removal of the second end of the cable from the shaft slot. When the lock is in the open mode, the shaft slot is located outside the lock body, allowing the second end of the cable to be removed from the shaft slot.

5 Claims, 11 Drawing Sheets

(51) Int. Cl.
*E05B 67/00* (2006.01)
*E05B 15/00* (2006.01)

(58) Field of Classification Search
CPC ..... E05B 73/0005; E05B 37/0031; E05B 37/0058; Y10T 70/415; Y10T 70/435; Y10T 70/483; Y10T 70/491; Y10T 70/7141; Y10T 70/7147
See application file for complete search history.

(56) References Cited

U.S. PATENT DOCUMENTS

| | | | | |
|---|---|---|---|---|
| 6,363,758 | B1 | 4/2002 | Ling | |
| 6,997,023 | B1 | 2/2006 | Huang | |
| 8,931,313 | B2 * | 1/2015 | Lai | E05B 37/025 70/284 |
| 9,663,970 | B1 * | 5/2017 | Yang | E05B 35/105 |
| 10,890,013 | B2 * | 1/2021 | Lai | E05B 37/025 |
| 2005/0044903 | A1 * | 3/2005 | Ling | E05B 67/02 70/30 |
| 2006/0075793 | A1 | 4/2006 | Yu | |
| 2008/0016922 | A1 | 1/2008 | Yu | |
| 2008/0196459 | A1 * | 8/2008 | Yu | E05B 37/025 70/285 |
| 2009/0120141 | A1 * | 5/2009 | Huang | E05B 37/025 70/24 |
| 2010/0307204 | A1 * | 12/2010 | Yu | E05B 37/025 70/58 |
| 2017/0073999 | A1 * | 3/2017 | Lai | E05B 37/0031 |
| 2018/0320416 | A1 * | 11/2018 | Lai | E05B 67/24 |
| 2020/0190855 | A1 * | 6/2020 | Lai | E05B 37/0058 |

FOREIGN PATENT DOCUMENTS

| | | | |
|---|---|---|---|
| CN | 105840009 | A | 8/2016 |
| DE | 202006020233 | U1 | 4/2008 |
| GB | 2569028 | A | 6/2019 |

OTHER PUBLICATIONS

Office Action, Chinese Application No. 201910548583.4, dated Sep. 27, 2020 (6 pages).

* cited by examiner

CABLE LOCK HAVING DUAL UNLOCKING MECHANISM

CROSS REFERENCE TO RELATED APPLICATION

This application claims priority to U.S. Provisional Application No. 62/694,244, filed Jul. 5, 2018, which is hereby incorporated by reference in its entirety.

TECHNICAL FIELD

The present invention relates generally to a padlock and, more specifically, to a cable lock having a dual unlocking mechanism.

BACKGROUND OF THE INVENTION

A cable lock is a lock having a flexible cable, instead of a shackle, arranged to pass through an opening to prevent an unauthorized use of an object or structure. In a lock having a dual unlocking mechanism, the lock can be opened by a combination locking system or by a key-overriding system. In a lock having a shackle, the lock body must have a reasonably long channel in the lock body to accommodate the heel of the shackle. If the toe is arranged to move up and down a distance to lock and open the lock, the heel must be allowed to move the same distance. With a flexible cable, one end of the cable can be fixedly attached to the lock body. There is no need to provide a long channel in the lock body to accommodate the cable.

SUMMARY OF THE DISCLOSURE

The present invention is directed to a cable lock having a flexible cable, instead of a shackle. The lock has a shaft moveable relative to the lock body so that the top part of the shaft can be moved out of the lock body to open the lock. The lock has a combination unlocking system and a key-overriding system. Thus, the lock can be unlocked by a lock-opening combination or by a correct key. The first end of the cable is fixedly attached to the lock body and the second end is removably engaged with a shaft slot near the top of the shaft. When the lock is operated in the locked mode, the shaft slot is located inside the lock body, preventing the second end of the cable from being removed from the shaft slot. When the lock is operated in the open mode, the shaft slot is located outside the lock body, allowing the second end of the cable to be removed from the shaft slot.

Thus, it is an aspect of the present invention to provide a lock operable in a locked mode and in an open mode. An embodiment of the lock comprises:

a cable having a first cable end and a second cable end;

a lock body arranged to secure the first cable end, the lock body having a cutout to receive the second cable end;

a shaft locatable in a first shaft position when the lock is operated in the locked mode and in a second shaft position when the lock is operated in the open mode, the shaft having a shaft slot arranged to secure the second cable end of the cable; and a plurality of clutches forming a clutch stack, the clutch stack arranged to control movement of the shaft in a movement direction relative to the lock body, wherein when the shaft is located in the first shaft position, the shaft slot is located inside the lock body, preventing the second cable end from being released from the lock body, and when the shaft is located in the second shaft position, the shaft slot is located outside the lock body, allowing the second cable end to be removed from the shaft slot.

According to an embodiment of the present invention, the lock further comprises:

a first unlocking mechanism operatively coupled to the clutch stack, and a second unlocking mechanism operatively coupled to the clutch stack, the first unlocking mechanism comprising a plurality of dials engageable with the clutch stack, wherein when the dials are arranged to match a lock-opening combination, the clutch stack is arranged to allow the shaft to move in the movement direction relative to the clutch stack from the first shaft position to the second shaft position, and wherein the second unlocking mechanism comprises a latch plate locatable in a first plate position to prevent the clutch stack from moving in the movement direction relative to the lock body, and in a second plate position to allow the clutch stack to move together with the shaft in the movement direction relative to the lock body, causing the shaft to move from the first shaft position to the second shaft position, wherein the second unlocking mechanism further comprises a cylinder operable by a key, the cylinder arranged to cause the latch to move from the first plate position to the second plate position.

According to an embodiment of the present invention, each of the dials is associated with a different one of the clutches and each of the clutches comprises an extended fin, and wherein each of the dials has a plurality of dial slots, each dial slot dimensioned to receive the extended fin of the associated clutch for rotation together, wherein the shaft further comprises a plurality of protrusions, each protrusion associated with one of the clutches, and each of the clutches has an inner ring with an opening gap formed thereon, and wherein when the lock is operated in the locked mode, the inner ring of at least one of the clutches is arranged to prevent the shaft from moving in the movement direction relative to the clutch stack so as to move the shaft slot out of the lock body, and when the dials are arranged to match the lock-opening combination, the opening gap on the inner ring of each of the clutches is aligned with the associated protrusion of the shaft, allowing the shaft to move in the movement direction relative to the clutch stack from the first shaft position to the second shaft position.

According to an embodiment of the present invention, the latch plate comprises a pin slot. The lock further comprises:

a cam having a cam slot and a cam pin, the cam pin movably engaged with the pin slot, and a cylinder having a key slot and a fork, the key slot dimensioned to receive a key, the fork engaged with the cam slot for rotation together, wherein when the key is inserted into the key slot to turn the cylinder along with the cam, the latch plate is caused to move from the first plate position to the second plate position.

According to an embodiment of the present invention, the lock body has a first body side and an opposing second body side, the first body side having a fixed-end slot to receive the first cable end and the cutout to receive the second cable end, wherein the inner ring of each of the clutches has an upper side and an opposing lower side, wherein the upper side is closer to the first body side than the second body side, wherein when the lock is operated in the locked mode, the shaft is located in the first shaft position, and each of the protrusions of the shaft is located adjacent to the lower side of the inner ring of the associated clutch and when the lock is caused to change from the locked mode to the open mode by the first unlocking mechanism, the shaft is located in the second shaft position, and each of the protrusions of the shaft is located adjacent to the upper side of the inner ring of the associated clutch, allowing the shaft to rotate relative to the lock body so that each of the protrusions of the shaft is spaced from the opening gap of the associated clutch while each of the protrusions of the shaft is located adjacent to upper side of the associated clutch, wherein when the shaft is pushed toward the second body side of the lock body, the clutch stack is caused to disengage from the dials, allowing the dials to be rotated independently of the clutches to set a different lock-opening combination.

DETAILED DESCRIPTION OF THE INVENTION

The present invention provides a lock 10 with dual unlocking mechanism: a combination unlocking system and a key overriding mechanism. Thus, the lock 10 can be opened by a lock-opening combination or by a correct key.

Figure 1A:
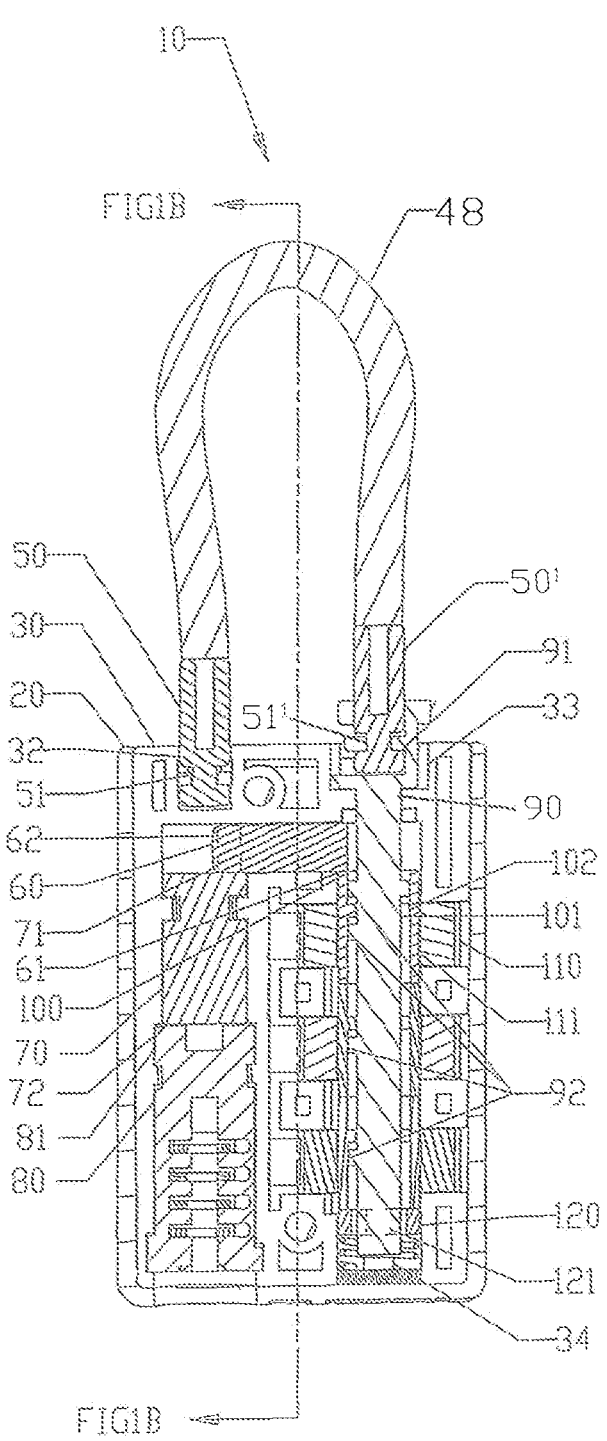
FIG. 1A is a cross-sectional view of the cable lock of the present invention in the locked mode.
Figure 1B:
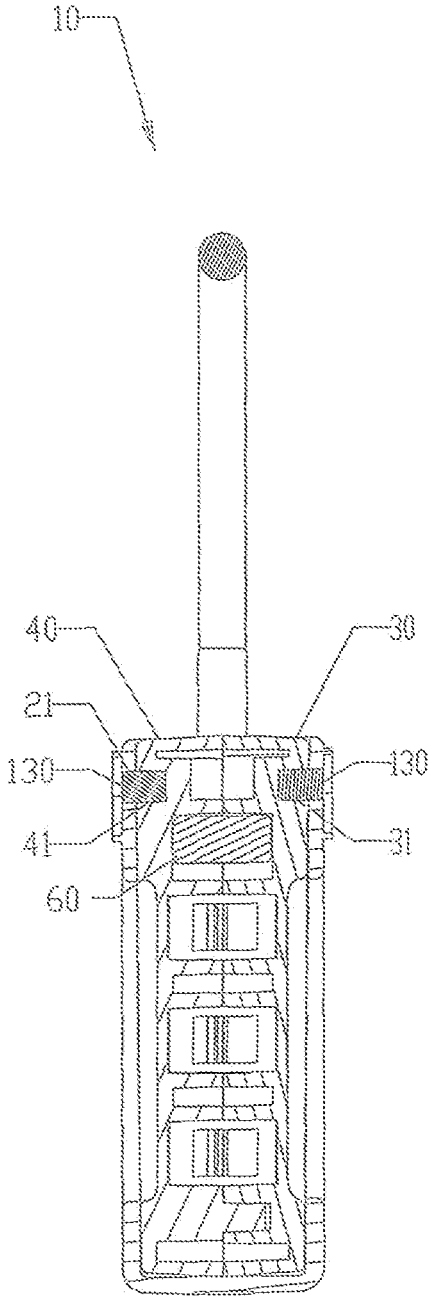
FIG. 1B is a cross-sectional view of the cable lock taken along the marked line of FIG. 1A.
Figure 2:
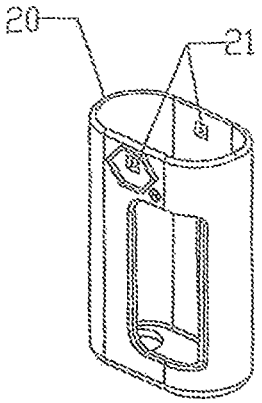
FIG. 2 is a perspective view of a cover.
Figure 3A:
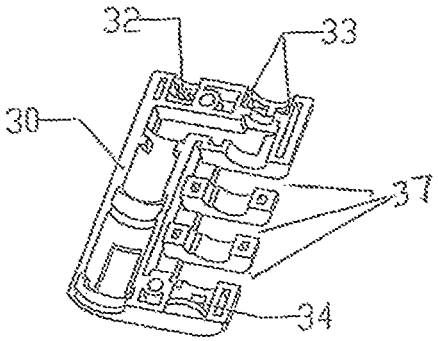
FIG. 3A is a perspective view of one half of the lock body.
Figure 3B:
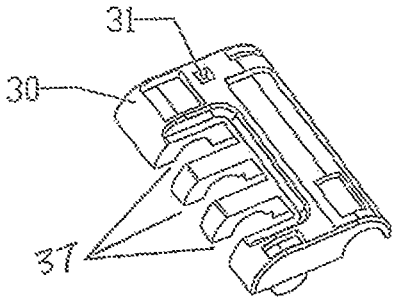
FIG. 3B is another perspective view of the same half of the lock body.
Figure 4A:
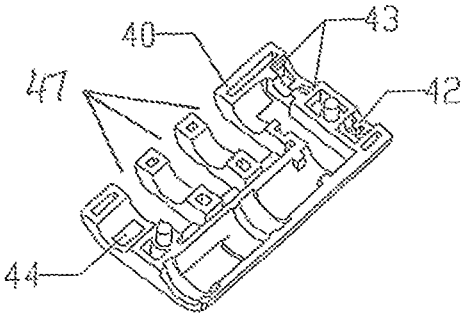
FIG. 4A is a perspective view of another half of the lock body.
Figure 4B:
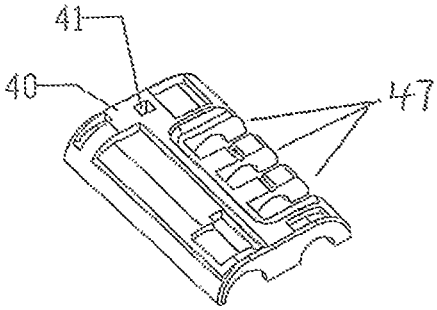
FIG. 4B is another perspective view of the body half of FIG. 4A.
Figure 5:
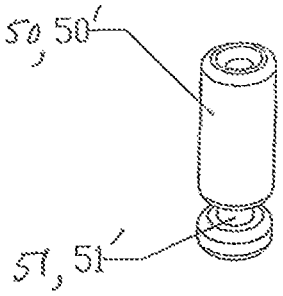
FIG. 5 is a perspective view of a cable end.
Figure 6:
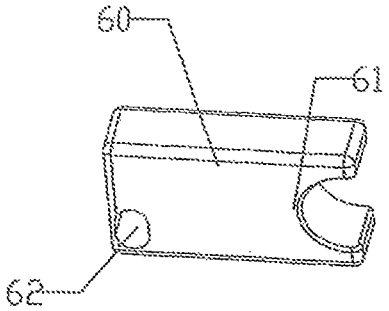
FIG. 6 is a perspective view of a latch plate.
Figure 7:
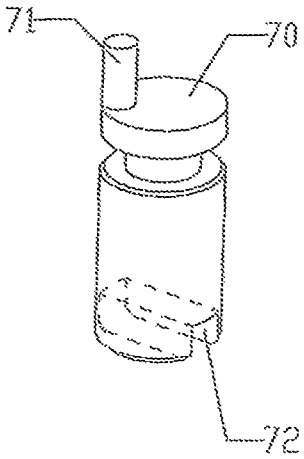
FIG. 7 is a perspective view of a cam.
Figure 8:
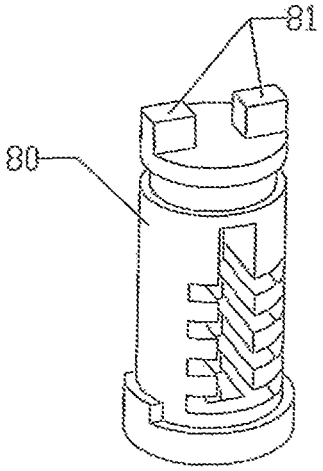
FIG. 8 is a perspective view of a cylinder.
Figure 9:
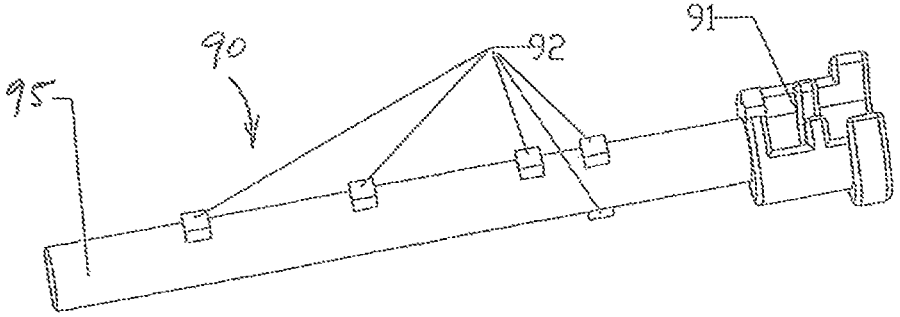
FIG. 9 is a perspective view of a shaft.
Figure 10:
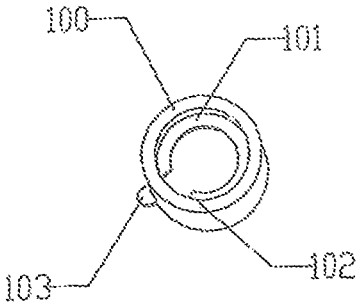
FIG. 10 is a perspective view of a clutch.
Figure 11:
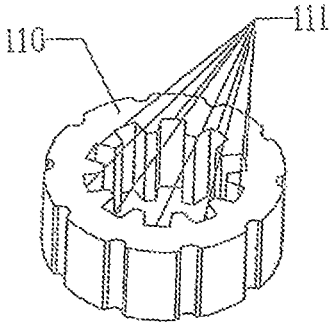
FIG. 11 is a perspective view of a dial.
Figure 12:
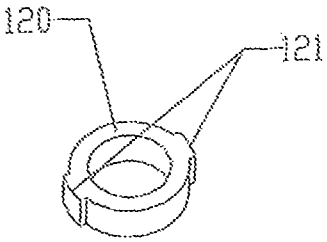
FIG. 12 is a perspective view of a spacer ring.
Figure 13A:
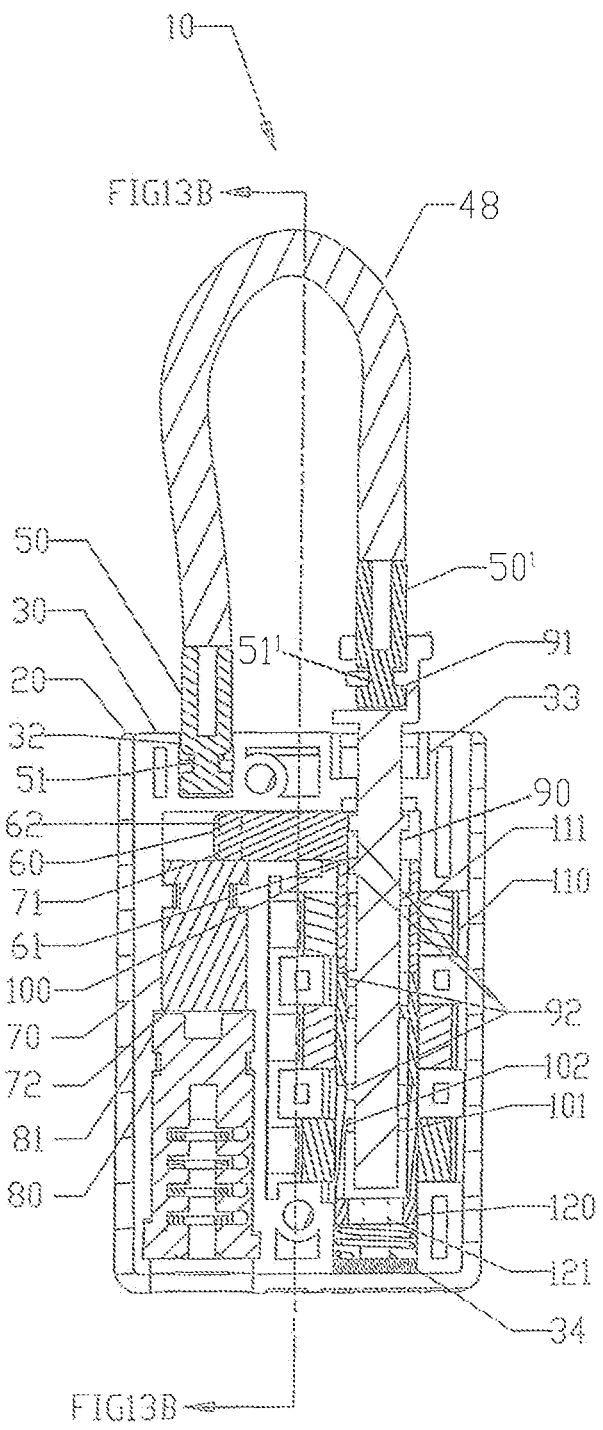
FIG. 13A is a cross-sectional view of the cable lock in the open mode unlocked by the lock-opening combination.
Figure 13B:
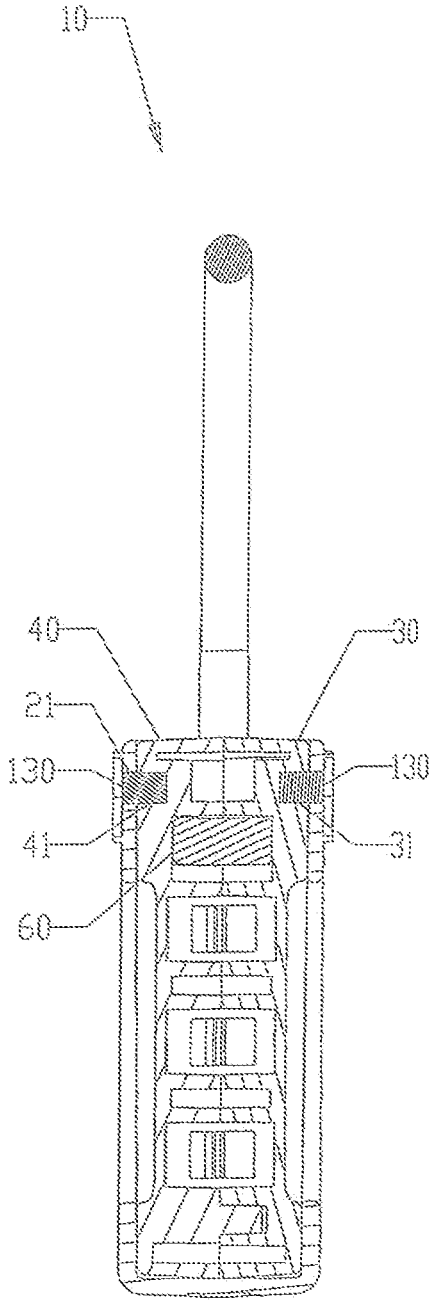
FIG. 13B is a cross-sectional view of the cable lock taken along the marked line of FIG. 13A.
Figure 14A:
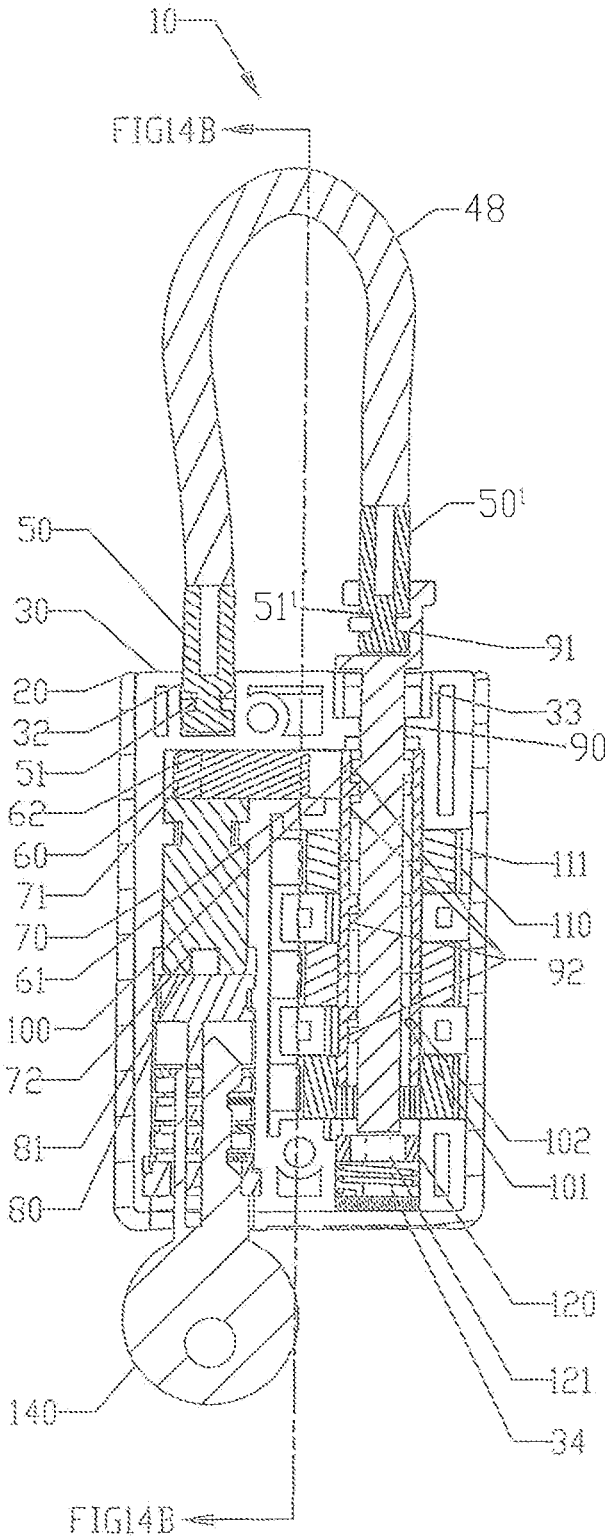
FIG. 14A is a cross-sectional view of the cable lock in the open mode unlocked by the key-overriding system.
Figure 14B:
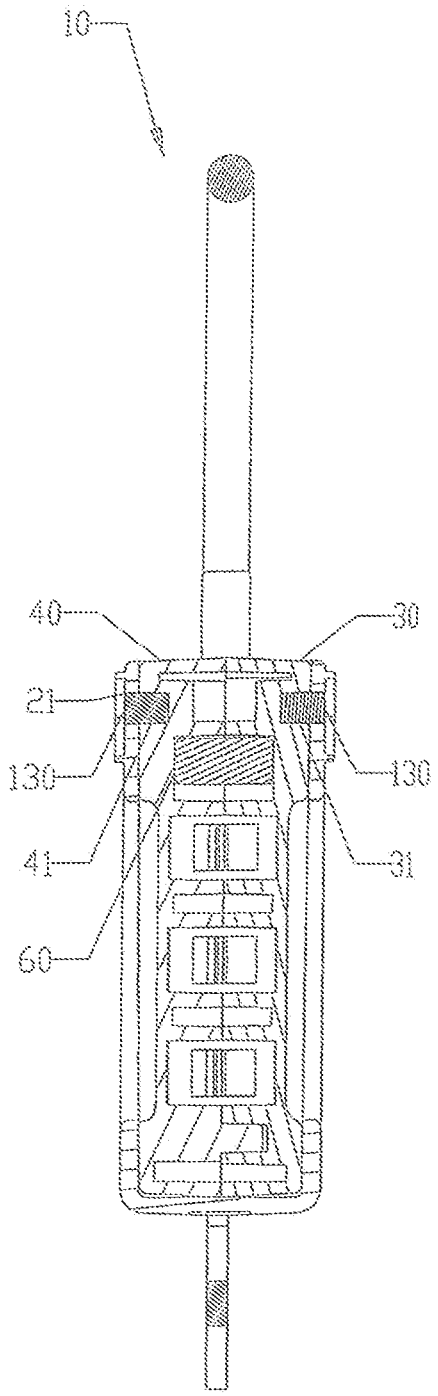
FIG. 14B is a cross-sectional view of the cable lock taken along the marked line of FIG. 14A.
Figure 15A:
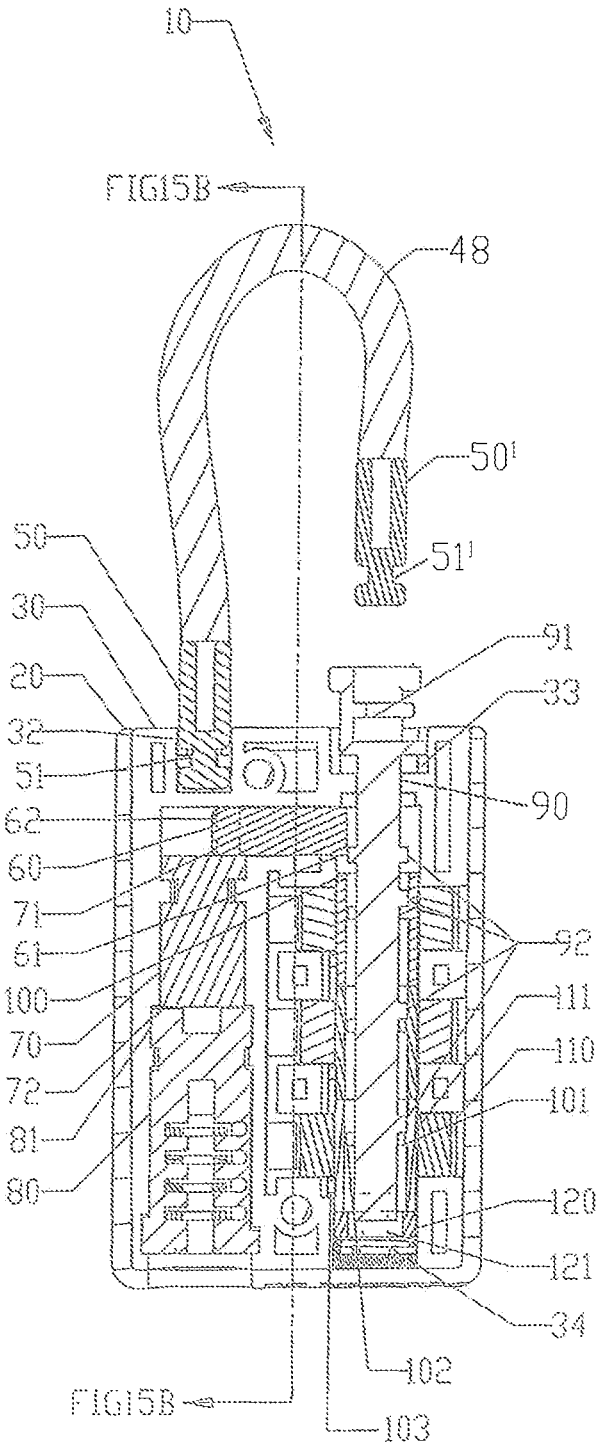
FIG. 15A is a cross-sectional view of the cable lock in the reset mode.
Figure 15B:
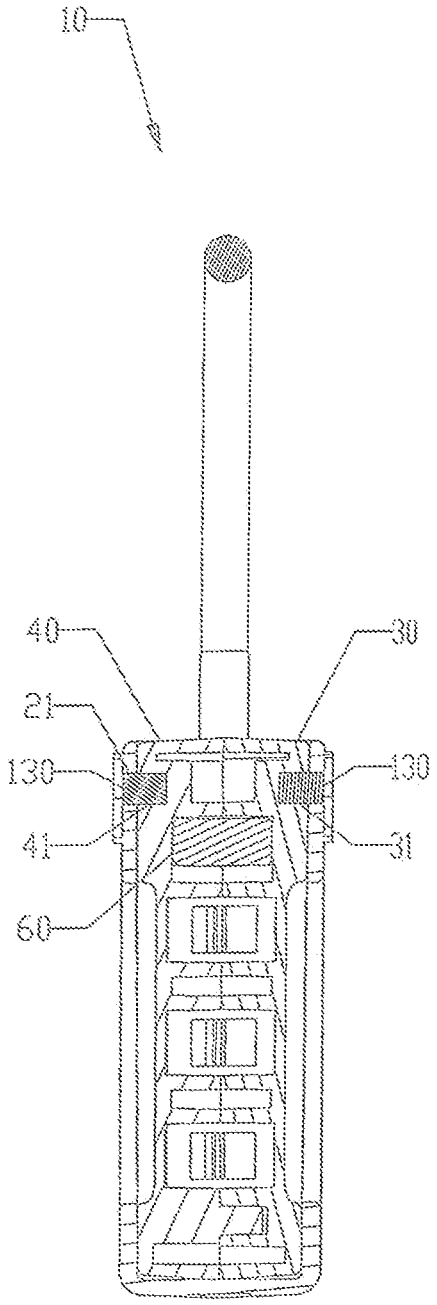
FIG. 15B is a cross-sectional view of the cable lock taken along the marked line of FIG. 15A.
Figure 16:
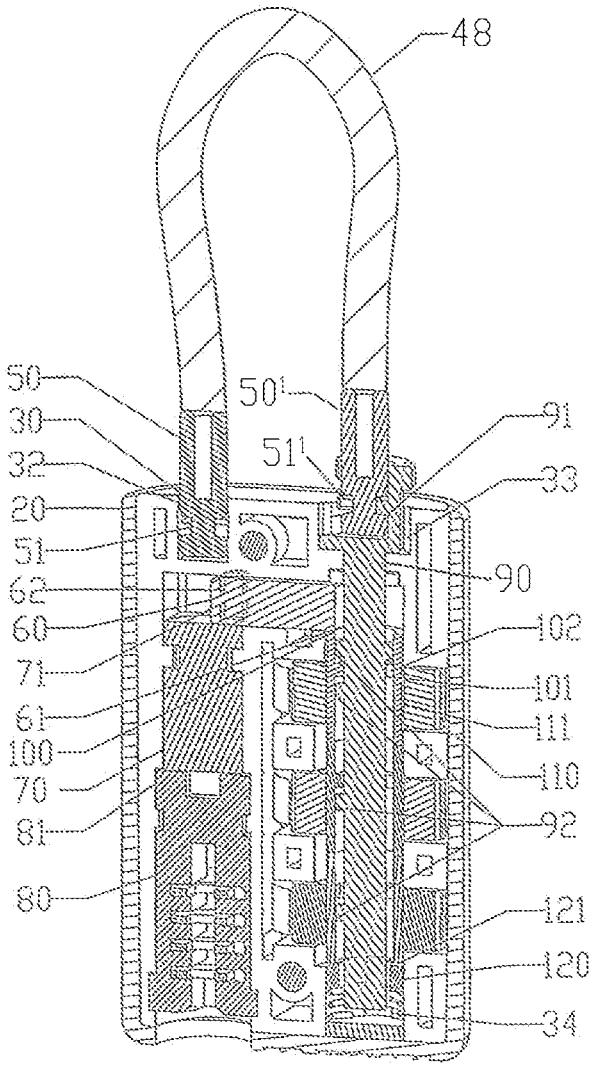
FIG. 16 is another cross-sectional view of the cable lock in the locked mode.
Figure 17:
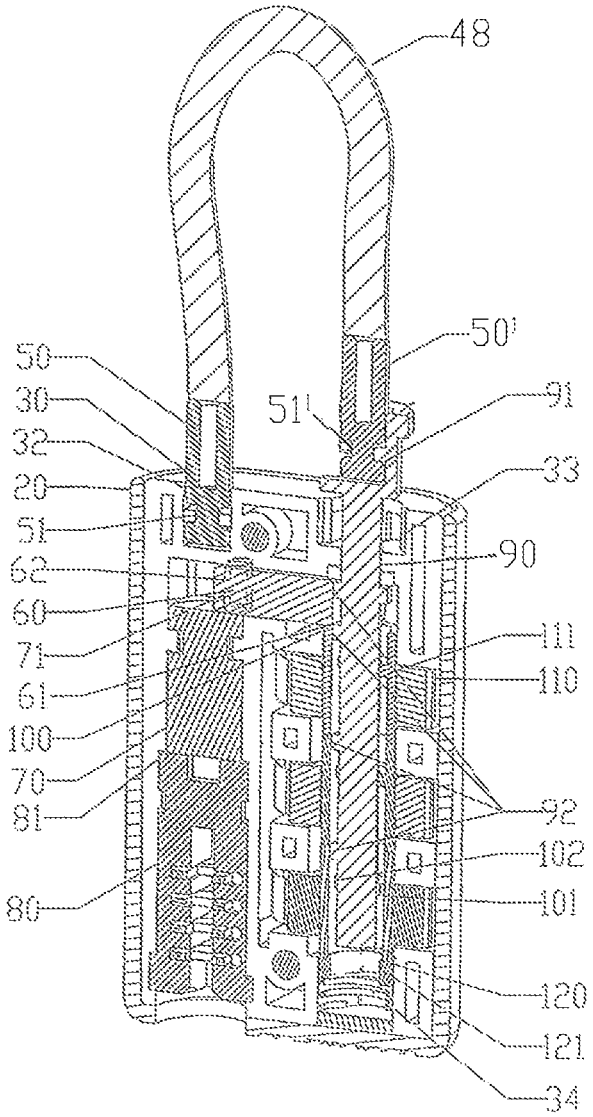
FIG. 17 is another cross-sectional view of the cable lock in the open mode unlocked by the lock-opening combination.
Figure 18:
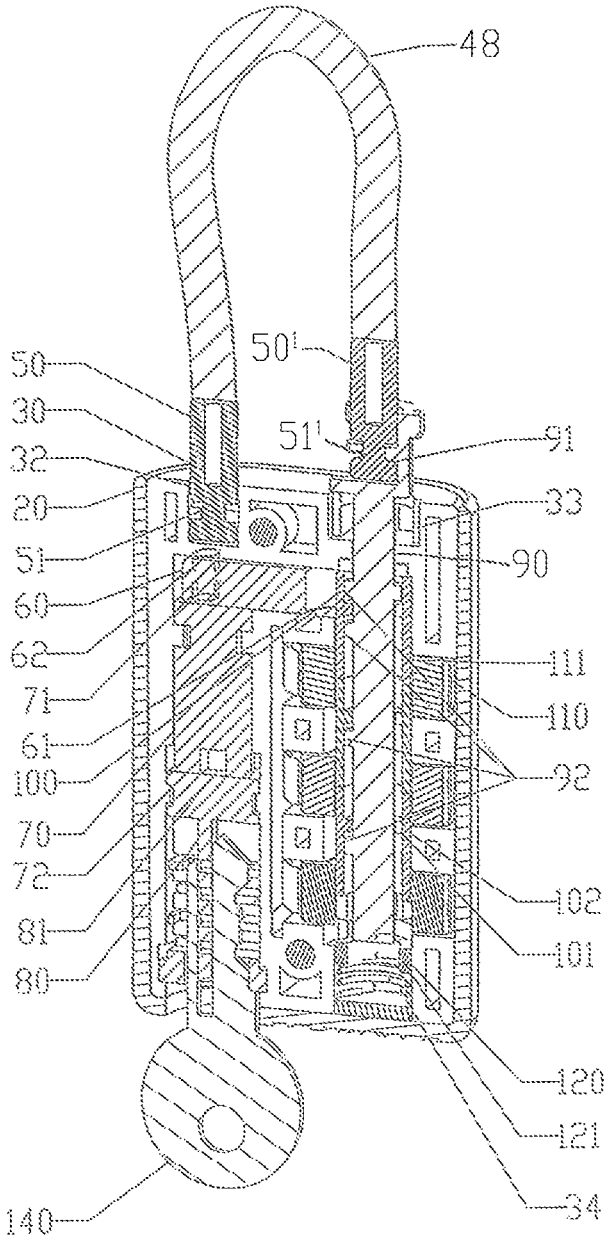
FIG. 18 is another cross-sectional view of the cable lock in the open mode unlocked by the key-overriding system.
Figure 19:
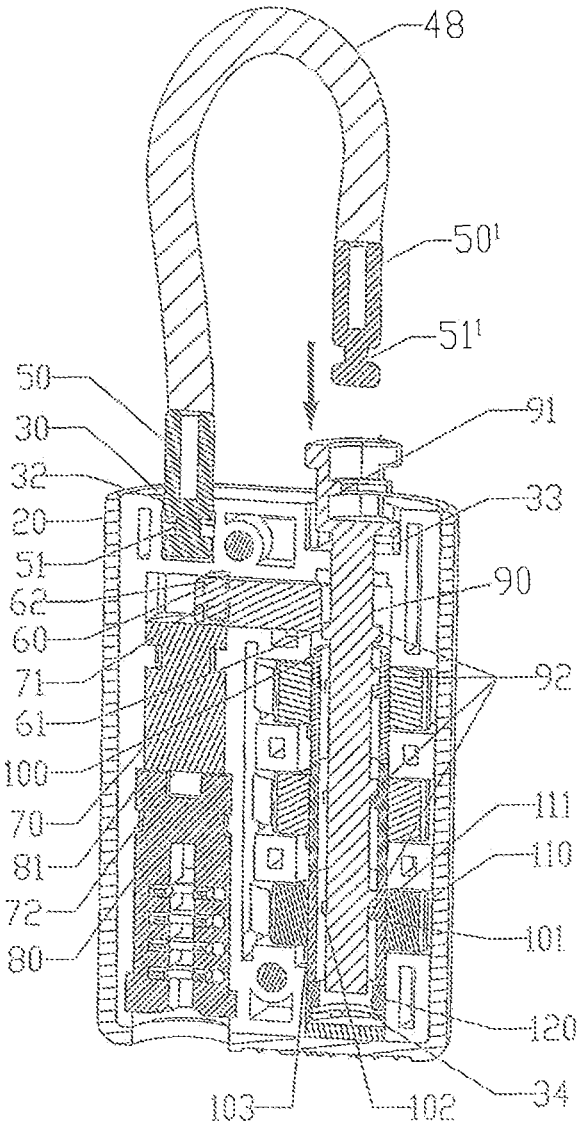
FIG. 19 is another cross-sectional view of the cable lock in the reset mode.

As seen in FIGS. 1A-19, the lock 10 has a lock body made of two halves 30,40 held together with one or more security pins 130 and a cover 20. The lock body 30/40 has a body channel dimensioned to receive a stack of clutches 100 and a shaft 90. The lock body 30/40 also has a plurality of body slots 37/47 to receive a plurality of dials 110, each dial 110 associated with a clutch 100. The shaft 90 has a shaft body 95 movably engaged with the stack of the clutches 100. The shaft 90 has a cable-neck slot 91 on the top part of the shaft body 95. The lock 10 comprises a cable 48 having a first cable end 50 secured in the lock body 30/40 and a second cable end 50' having a cable neck 51' removably engaged with the cable-neck slot 91. The lock body also has a shaft-protrusion cutout 33/43 in communication with the body channel, the shaft-protrusion cutout 33/43 dimensioned to receive the cable-neck slot 91 when the lock 10 is operated in a locked mode. Each of the clutches 100 has an extended fin 103 located on the clutch's outer surface, and an inner ring 101 having an opening gap 102 formed thereon. Each of the dials 110 has a plurality of dial slots 111 dimensioned to receive the extended fin 103 so that when each of the dials 110 is turned, the associated clutch 100 is also turned. The shaft body 95 of shaft 90 has a plurality of protrusions 92, each protrusion 92 associated with a clutch 100. Each of the protrusions 92 is located below the inner ring 101 of an associated clutch 100 when the lock 10 is operated in the locked mode. The opening gap 102 on the inner ring 101 is dimensioned to allow the protrusion 92 to pass through to open the lock by the combination unlocking system.

The combination unlocking system is controlled by the dials 110 such that when the dials 110 are turned to match a preset lock-opening combination, the opening gap 102 of each of the clutches 100 is aligned with the associated protrusion 92 of shaft 90, allowing the shaft 90 to move upward relative to the clutches 110 so that the cable-neck slot 91 is moved out of the shaft-protrusion cutout 43. The cable neck 51' of the cable 48 can then be released from the cable-neck slot 91 to open the lock 10.

The lock 10 has a latch plate 60 movable between a first latch position and a second latch position. The latch plate 60 has a blocking surface 61. When the latch plate 60 is located in the first latch position, the blocking surface 61 of the latch plate 60 is in contact with the upper surface of the topmost clutch 100, preventing the stack of clutches 100 from moving upward relative to the lock body. When the latch plate 60 is located in the second latch position, the blocking surface 61 is spaced from the topmost clutch 100, allowing the stack of clutches 100 to move upward together with the shaft 90. The key-overriding system is controlled by a cylinder 80 and a cam 70. The cam 70 has a cam slot 72 provided on the lower surface of cam 70 and an extended pin 71 extended from the upper surface of cam 70. The cylinder 80 has an extended fork 81 arranged to engage with the cam slot 72 for rotation together. The latch plate 60 also has a pin-receiving slot 62 dimensioned to receive the extended pin 71 of cam 70. When a correct key 140 is inserted into the cylinder 80 to turn the cylinder 80, the cam 70 is also turned in the same manner. As the cam 70 turns, the extended pin 71 of cam 70 moves the latch plate 60 away from the top surface of the stack of clutches 100. As such, the shaft 90 can be pulled upward along with the entire stack of clutches 100 so that the cable-neck slot 91 of shaft 90 is moved out of the shaft-protrusion cutout 33/43 of lock body 30/40. The cable neck 51' of the cable 48 can then be released from the cable-neck slot 91 for lock opening.

Locked Mode (FIGS. 1A-12 and FIG. 16):

When the lock 10 is operated in the locked mode, the cable-neck slot 91 of the shaft 90 is located in the shaft-protrusion cutout 33/43 of lock body 30/40, preventing the cable end 50' of cable 48 from being released from the cable-neck slot 91.

In the locked mode, the setting of dials 110 is different from the lock-opening combination. The opening-gap 102 of at least one of the clutches 100 is not aligned with the associated protrusion 92 of shaft 90, and the protrusion 92 is located directly below the inner ring 101 of the at least one of the clutches 100. The inner ring 101 of the at least one of the clutches 100 prevents the shaft 90 from moving upward relative to the stack of the clutches 100. As the cable-neck slot 91 of shaft 90 remains in the shaft-protrusion cutout 33/43 of lock body 30/40, the cable end 50' of cable 48 cannot be released from the cable-neck slot 91. At the same time, the latch plate 60 is located at the first latch position, preventing the stack of the clutches 100 and the shaft 90 from moving upward.

Furthermore, when the key 140 is not present, the cylinder 80 and the cam 70 cannot turn to move the latch plate 60 from the first latch position to the second latch position.

Unlock by Combination (FIGS. 13A-13B and FIG. 17):

When the lock 10 is operated in the locked mode, the opening gap 102 of at least one of the clutches 100 is misaligned with the associated protrusion 92 of shaft 90, and the protrusion 92 is located directly below the inner ring 101 of the at least one of the clutches 100. The inner ring 101 acts as a barrier to prevent the associated protrusion 92 from moving through. Thus, the shaft 90 cannot move relative to the clutches 100. At the same time, the extended fin 103 of each of the clutches 100 resides in one of the dial slots 110 of the associated dial 110, causing the clutch 100 to rotate along with the associated dial 110. When the dials 110 are turned to match the lock-opening combination, the opening gap 102 of each of the clutches 100 is aligned with the protrusion 92 of shaft 90. The inner ring 101 of a clutch 100 is no longer a barrier to the associated protrusion 92 of shaft 90. As such, the shaft 90 can be pulled upward relative to the clutches 100 so that the cable-neck slot 91 is moved out of the shaft-protrusion cutout 33/43 of lock body 30/40 (see FIG. 13A, for example). The cable end 50' can then be moved sidewise to release the cable neck 51' of cable 48 from the cable-neck slot 91 of shaft 90 to open the lock 10. It should be noted that when the lock 10 is unlocked by the combination unlocking system, the latch plate 60 is located in the first plate position and the blocking surface 61 prevents the clutches 100 from moving upward relative to the lock body 30/40. The shaft 90 is the only component in lock 10 that has a vertical movement relative to the lock body 30/40.

Reset Combination (FIGS. 15A-15B and FIG. 19):

As the shaft 90 is pulled upward to unlock the lock 10 by the combination unlocking system, each of the protrusions 92 of shaft 90 is located above the opening gap 102 on the inner ring 101 of the associated clutch 100. The shaft 90 can rotate freely relative to lock body 30/40. The user can turn the shaft 90 over a pre-determined angle (for example, the shaft 90 is rotated in a clockwise direction by 180 degrees) and push the shaft 90 downward. After the shaft 90 is turned, the protrusions 92 are moved away from the opening gaps 102 of the inner rings 101. As the shaft 90 is pushed downward, it pushes the clutches 100 downward, causing the extended fins 103 of clutches 100 to disengage from the dial slot 111 of dials 110. The dials 110 can be rotated independently of the clutches 100 to set a different lock-opening combination. When the shaft 90 is released, the spring below the spacer ring 120 is arranged to push the spacer ring 120 and the clutches 100 upward to their original positions so that each of the extended fins 103 of clutches 100 is again engaged with the dial slot 111 of the associated dial 110. The spacer ring 120 has an outer protrusion 121 in the reset-protrusion slot 34/44 so that the spacer ring 120 is prevented from falling out when the lock 10 is being unlocked by the key-overriding system.

Unlock by Key (FIGS. 14A-14B and FIG. 18):

According to an embodiment of the present invention, the extended fork 81 of cylinder 80 is always engaged with the cam slot 72 of cam 70. When the correct key 140 is inserted into the cylinder 80, the cylinder 80 can be turned along with the cam 70 relative to the lock body 30/40. As the cam 70 is turned, the extended pin 71 of cam 70 residing in the pin-receiving slot 62 of the latch plate 60 causes the latch plate 60 to move away from the stack of clutches 100. As such, the blocking surface 61 of the latch plate 60 is moved away from the upper surface of the topmost clutch 100. The entire stack of the clutches 100 can be pulled upward together with the shaft 90 so that the cable-neck slot 91 of shaft 90 is moved out of the lock body 30/40. The cable end 50' of cable 48 can be released from of the cable-neck slot 91 of shaft 90. However, while the duals 110 remains in the body slots 37/47 of lock body 30/40, the dials 110 are still engaged with the stack of clutches 100, preventing the dials 110 from turning relative to the clutches 100. Thus, the lock-opening combination cannot be changed when the lock 10 is unlocked by the key-overriding mechanism.

Other Features:

The lock body 30/40 has a fixed-cable-end slot 32/42 which is arranged to receive the neck 51 of the first cable end 50 of cable 48. The first cable end 50 is always secured to the lock body 30/40.

According to an embodiment of the present invention, the body half 30 has a security-pin hole 31 and the body half 40 has a security-pin hole 41. The lock 10 has a cover 20 with two pin holes 21, each aligned with one of the security-pin holes 31 and 41 to receive a security pin 130. The cover 20 and the lock body 30/40 are bonded together as one piece.

According to the present invention, the first cable end 50 and the second cable end 50' are identical. However, the cable end 50 can be different from the cable end 50'. Furthermore, each of the clutches 100 has only one extended fin 103 arranged to engage with one of the dial slots 111 so that the clutch 100 is rotated together with the associated dial 110. However, each of the clutches 100 can have two or more extended fins 103.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A lock operable in a locked mode and an open mode, comprising a cable having a first cable end and a second cable end;

a lock body arranged to secure the first cable end, the lock body having a cutout to receive the second cable end;

a shaft locatable in a first shaft position when the lock is operated in the locked mode and in a second shaft position when the lock is operated in the open mode, the shaft having a shaft slot arranged to secure the second cable end of the cable; and a plurality of clutches forming a clutch stack, the clutch stack arranged to control movement of the shaft in a movement direction relative to the lock body, wherein when the shaft is located in the first shaft position, the shaft slot is located inside the lock body, preventing the second cable end from being released from the lock body, and when the shaft is located in the second shaft position, the shaft slot is located outside the lock body, allowing the second cable end to be removed from the shaft slot.

2. The lock according to claim 1, further comprising a first unlocking mechanism operatively coupled to the clutch stack, and a second unlocking mechanism operatively coupled to the clutch stack, the first unlocking mechanism comprising a plurality of dials engageable with the clutch stack, wherein when the dials are arranged to match a lock-opening combination, the clutch stack is arranged to allow the shaft to move in the movement direction relative to the clutch stack from the first shaft position to the second shaft position, and wherein the second unlocking mechanism comprises a latch plate locatable in a first plate position to prevent the clutch stack from moving in the movement direction relative to the lock body, and in a second plate position to allow the clutch stack to move together with the shaft in the movement direction relative to the lock body, causing the shaft to move from the first shaft position to the second shaft position, wherein the second unlocking mechanism further comprises a cylinder operable by a key, the cylinder arranged to cause the latch to move from the first plate position to the second plate position.

3. The lock according to claim 2, wherein each of the dials is associated with a different one of the clutches and each of the clutches comprises an extended fin, and wherein each of the dials has a plurality of dial slots, each dial slot dimensioned to receive the extended fin of the associated clutch for rotation together, wherein the shaft further comprises a plurality of protrusions, each protrusion associated with one of the clutches, and each of the clutches has an inner ring with an opening gap formed thereon, and wherein when the lock is operated in the locked mode, the inner ring of at least one of the clutches is arranged to prevent the shaft from moving in the movement direction relative to the clutch stack so as to move the shaft slot out of the lock body, and when the dials are arranged to match the lock-opening combination, the opening gap on the inner ring of each of the clutches is aligned with the associated protrusion of the shaft, allowing the shaft to move in the movement direction relative to the clutch stack from the first shaft position to the second shaft position.

4. The lock according to claim 3, wherein the latch plate comprises a pin slot, said lock further comprising:

a cam having a cam slot and a cam pin, the cam pin movably engaged with the pin slot, and a cylinder having a key slot and a fork, the key slot dimensioned to receive a key, the fork engaged with the cam slot for rotation together, wherein when the key is inserted into the key slot to turn the cylinder along with the cam, the latch plate is caused to move from the first plate position to the second plate position.

5. The lock according to claim 3, wherein the lock body has a first body side and an opposing second body side, the first body side having a fixed-end slot to receive the first cable end and the cutout to receive the second cable end, wherein the inner ring of each of the clutches has an upper side and an opposing lower side, wherein the upper side is closer to the first body side than the second body side, wherein when the lock is operated in the locked mode, the shaft is located in the first shaft position, and each of the protrusions of the shaft is located adjacent to the lower side of the inner ring of the associated clutch and when the lock is caused to change from the locked mode to the open mode by the first unlocking mechanism, the shaft is located in the second shaft position, and each of the protrusions of the shaft is located adjacent to the upper side of the inner ring of the associated clutch, allowing the shaft to rotate relative to lock body so that each of the protrusions of the shaft is spaced from the opening gap of the associated clutch while each of the protrusions of the shaft is located adjacent to upper side of the associated clutch, wherein when the shaft is pushed toward the second body side of the lock body, the clutch stack is caused to disengage from the dials, allowing the dials to be rotated independently of the clutches to set a different lock-opening combination.

* * * * *